United States Patent [19]

Crowe

[11] 4,201,494

[45] May 6, 1980

[54] INSTALLING PANELS OF INTERLOCKING BLOCKS

[76] Inventor: Robert E. Crowe, 520 Nelson Ct., Milton, Ontario, Canada, L9T 3A6

[21] Appl. No.: 3,877

[22] Filed: Jan. 16, 1979

[51] Int. Cl.[2] ..... E02B 3/12; E02B 3/14

[52] U.S. Cl. ..... 405/17; 405/303

[58] Field of Search ..... 405/17, 16, 19, 20, 405/303

[56] References Cited

U.S. PATENT DOCUMENTS

| | | | |
|---|---|---|---|
| 1,892,701 | 1/1933 | Hoffman | 405/17 |
| 2,570,271 | 10/1951 | Picket | 405/19 |

FOREIGN PATENT DOCUMENTS

| | | | |
|---|---|---|---|
| 8600 | 5/1908 | France | 405/19 |

*Primary Examiner*—Alexander Grosz

*Attorney, Agent, or Firm*—Ridout & Maybee

[57] ABSTRACT

Installation of panels of interlocking blocks for erosion control purposes uses apparatus for hoisting the panels into position comprising parallel suspension cables passing through the panel and a laterally removable support bar releasably locked to the cables which bar sustains the weight of the panel and transfers it to the cables. Upon the release of the support bar, the suspension cables may be drawn out of the panel while drawing permanent reinforcing wires or cables into position behind them. The suspension cables are connected to a top support bar by means for equalizing the loadings on the cables.

8 Claims, 5 Drawing Figures

INSTALLING PANELS OF INTERLOCKING BLOCKS

FIELD OF THE INVENTION

This invention relates to apparatus for laying preassembled panels of interlocking blocks used for erosion control purposes.

BACKGROUND OF THE INVENTION AND PRIOR ART STATEMENT

The invention is directed to erosion control systems of the type in which a surface to be protected is covered with a layer of interlocking concrete blocks, usually laid on top of a filter mat or blanket which allows free passage of water but prevents erosion of underlying material. Sometimes the blocks in such systems are interconnected by wires passing through holes in the blocks, the wires usually being of stainless steel so as to resist corrosion.

It has been proposed, in order to facilitate laying of the blocks, particularly when the surface to be protected is partially below water during installation of the blocks, to preassemble the blocks into panels which are strung together using the wires which will connect the blocks, and bodily laid in place using a crane. The panels may either be preassembled on site, or assembled elsewhere and brought to the site on a truck or barge.

A problem using such a system is that the wires connecting the blocks need to be strong enough reliably to support the panels during the operations of hoisting the panel and laying it in position. Even assuming that during the hoisting operation, the wires are arranged to run vertically through the panel, the stresses on the wires will be considerable, and there is no guarantee that they will be evenly distributed over the different wires. This necessitates the use of considerably heavier wire to assemble the panels than is actually necessary to maintain the integrity of the panel once laid in position, and since the wire utilized is of stainless steel and expensive, the problem militates against the utilization of the system where alternatives are available. It also severely restricts the size of panel that can be handled if wires of reasonable gauge are to be utilized.

The present invention is directed towards overcoming this problem.

SUMMARY OF THE INVENTION

According to the invention, apparatus for laying preassembled panels of interlocking blocks comprises a bottom support bar for supporting the weight of the blocks when suspended in a vertical plane, a plurality of parallel suspension cables passing vertically through passages in said blocks and through said bottom support bar, and an upper support bar from which said cables are suspended at their top ends, the cables having means at their bottom ends for releasably connecting thereto further wires or cables, the bottom support bar and the cables having mutually engageable abutment means whereby the weight of the panel may be transferred from the support bar to the cables, the bar being laterally moveable into and out of the plane of the panel between a position in which said abutment means are engaged and a position in which the bar is free of the cables. Preferably locking means are provided to lock said abutment means in engagement.

In one preferred arrangement, the bar is of inverted channel section, and is slotted in its top and side to receive the cables and the abutment means on the cables, the edges of the slots in the top of the channel section forming the abutment on the bar. A second bar slides within the support bar, and is provided with L-shaped slots, the one arms of which extend to the edge of the bar, the bar being moveable between a position in which said one arms coincide with the slots in the support bar, permitting it to be engaged with or withdrawn from the cables, and a position in which the slots do not coincide, thus locking the cables within the other arms of the L-shaped slots if the abutments are in engagement.

Preferably also the suspension cables are connected to the upper support bar by means adapted at least to some extent to equalize the loadings on the cables. In one preferred arrangement, a cable is connected between ends of the upper support bar, and pulleys secured to the support bar at intermediate points are in engagement with the cable so that the latter forms a series of depending loops, a second series of pulleys is suspended from these loops, and the suspension cables are connected to the pulleys of these further series. Conveniently, each adjacent pair of suspension cables is formed by a single length of cable, a further pulley is suspended from each pulley of said second series of pulleys, and the length of cable forming each pair of suspension cables is looped over one of said further pulleys. A spreader bar, slotted to receive the cables, is placed on top of the preassembled panel to sustain lateral forces which would otherwise be transmitted to the blocks by the suspension cables.

The action of the various pulleys ensures that the loads on the suspension cables are substantially equalized, thus reducing the load rating required of the cables.

The use of the disengageable bottom support bar means that after a panel has been laid in place, the bottom support bar may be released and removed, and the suspension cables may be drawn out of the panel from its top end. The coupling means at the bottom ends of the cables mean that permanent cables or wires, which may be of lesser gauge, may simultaneously be drawn into position in the panels and left in place permanently in order to bind the panels together.

Further features of the invention will become apparent from the following description of a preferred embodiment thereof with reference to the accompanying drawings:

SHORT DESCRIPTION OF THE DRAWINGS

DESCRIPTION OF THE PREFERRED EMBODIMENT

Figure 1:
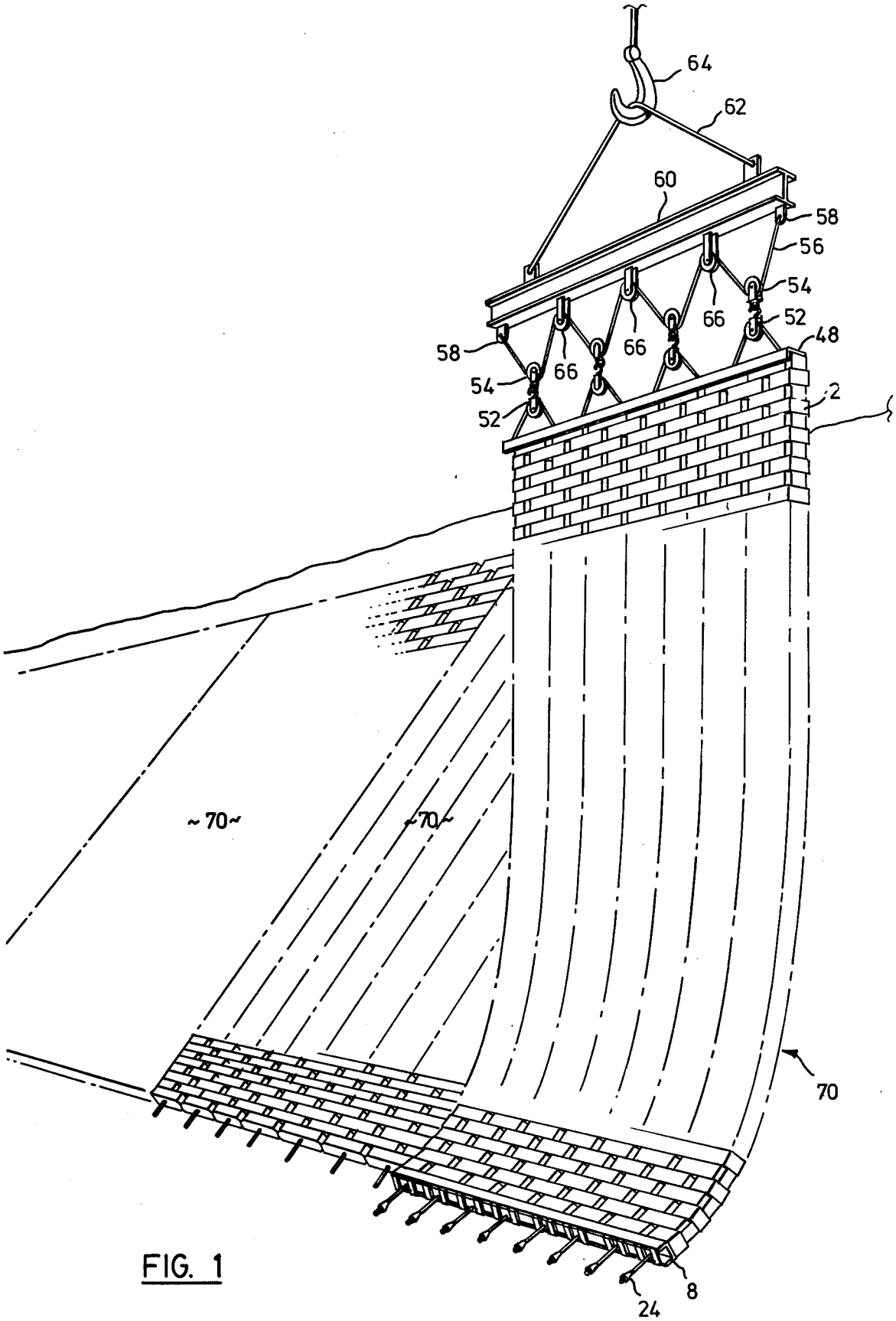
FIG. 1 is a perspective view showing a panel of interlocking blocks in the process of being laid in position on a slope which is to be protected against erosion.
Figure 2:
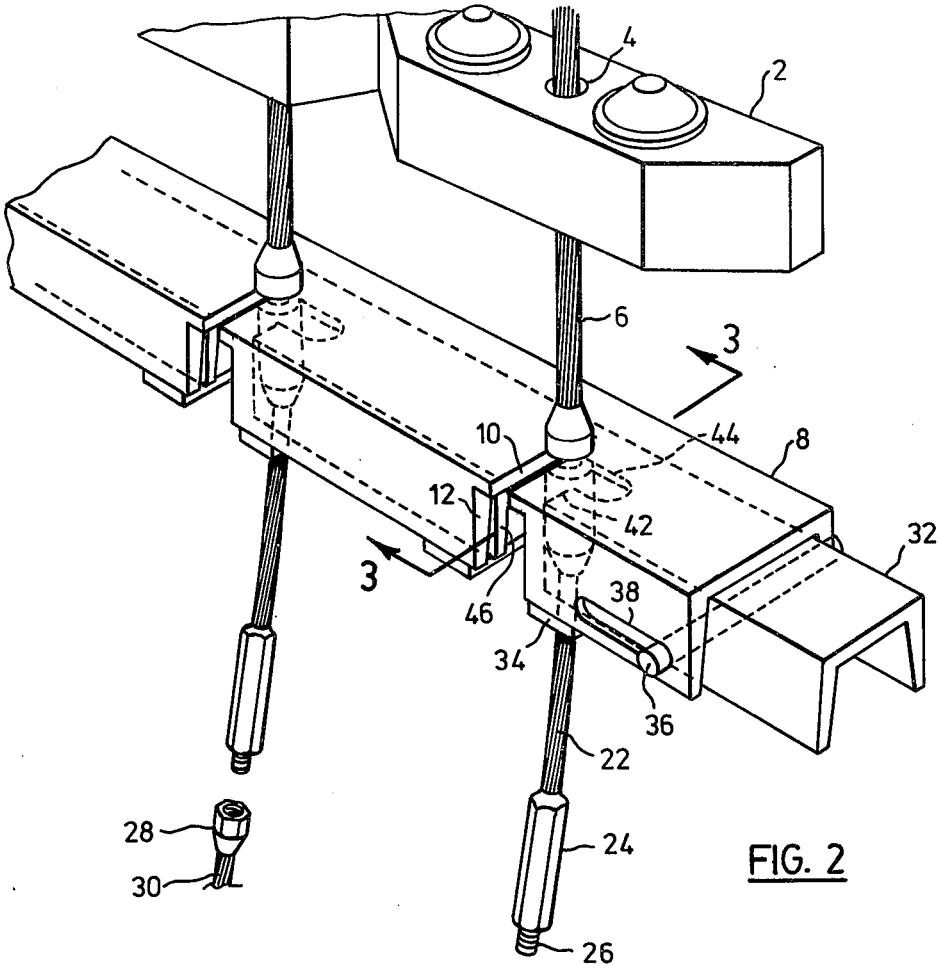
FIG. 2 is a detail showing a portion of a bottom support bar and suspension cables forming part of apparatus in accordance with the invention.
Figure 3:
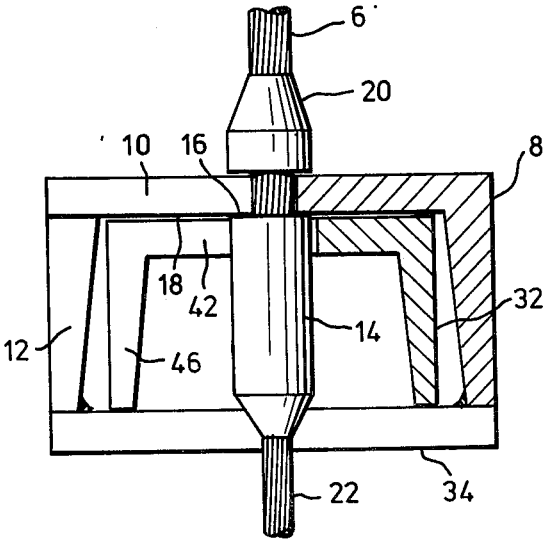
FIG. 3 is a vertical section through the bottom support bar.
Figure 4:
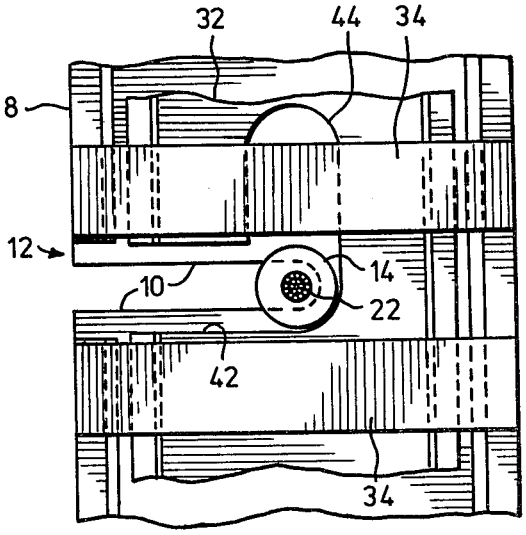
FIG. 4 is an underside plan of a portion of the bottom support bar.
Figure 5:
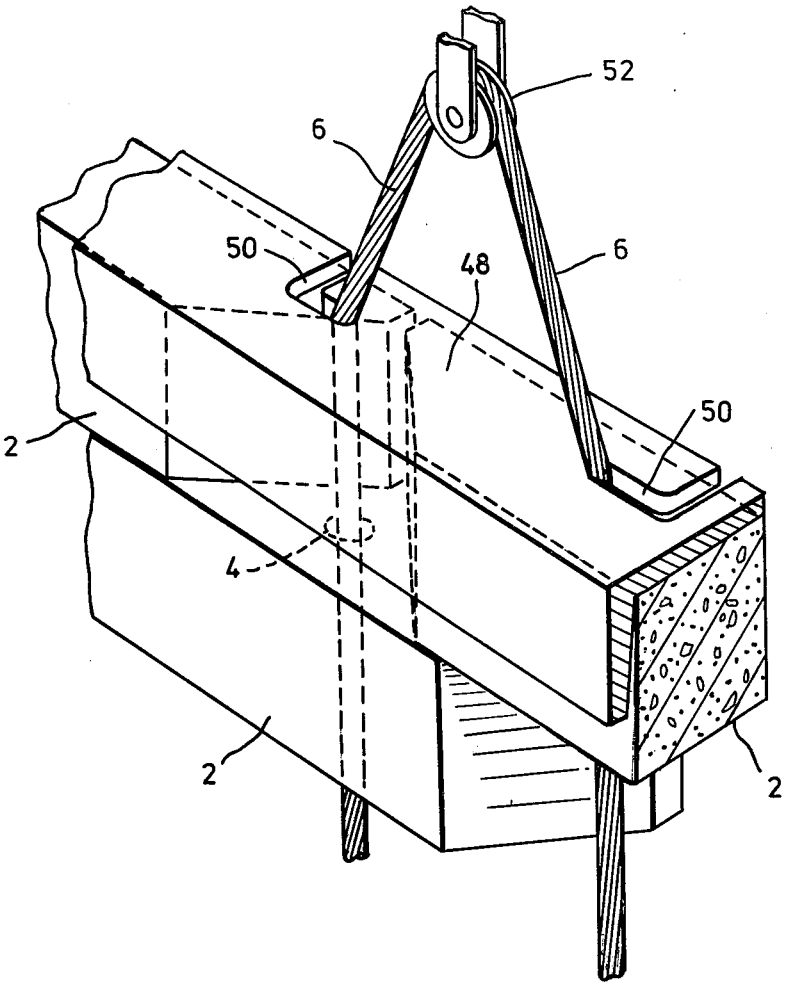
FIG. 5 is a perspective view showing a portion of the top of the panel during its placement into position.

Referring to FIG. 1, a preassembled panel of interlocking concrete blocks is shown being lowered into position, utilizing apparatus in accordance with the invention. The form of the blocks themselves does not form part of the invention, but conveniently they may be of the kind and applied in the manner described in Canadian Pat. No. 957,169. It is of course important that the blocks are formed with vertical bores which are aligned when the blocks are interengaged to form panels so as to enable the passage through the assembled panels of wires or cables used to connect the blocks together and to help maintain the integrity of the covering structure produced by the panels once laid in position. Thus in FIGS. 2 and 5 it can be seen how the blocks 2 are provided with apertures for permitting the passage therethrough of wires or cables.

In practice, the blocks forming the panel will be preassembled on a convenient horizontal surface, and in practicing the invention, suspension cables 6 will be passed through the aligned passages 4 in the blocks from top to bottom of the panel. In a preferred arrangement, pairs of suspension cables 6 are formed by a single high tensile stainless steel cable looped in two so that the free ends of the cables project from the bottom of the panel.

To support the bottom of the panel when the latter is lifted, and to transfer the weight of the blocks 2 to the suspension cables 6, a bottom support bar 8 is utilized. This bar is of inverted channel section, and has a number of slots, equal in number and spacing to the suspension cables, cut into its one side wall and part of the width of its top wall. The slots 10 in the top wall allow lateral engagement of the bar with the cables, whilst the broader slots 12 in the side wall admit ferrules 14 secured to the ends of the cables 6. The top surfaces 16 of the ferrules form abutments which engage with the lateral edges 18 of the slots 10 so as to transfer the weight of blocks resting on the bar 8 to the cables when the latter is engaged with the cables and the panel is suspended. A chamfered collar 20 permits the cable to be drawn through the apertures in the blocks 2 without snagging of the ferrule. The bottom end of the ferrule 14 is itself chamfered for the same reason. Extending below the ferrule 14 is a further length of cable 22 terminating in a further ferrule 24 with a screw threaded end portion 26. This threaded end portion 26 may either be covered with a rounded cap to facilitate insertion of the cable into a panel of blocks, or may be used for connection to a threaded end piece 28 on a wire or cable 30 intended for permanent installation in the panel.

Within the channel of the bar 8 is a further channel section bar 32 which is retained therein by cross straps 34 bridging the channel of the member 8, the bar 32 being capable of lengthwise motion limited by a pin 36 passing through the channel 32 and engaging slots 38 in the bar 8. The bar 32 has a series of slots in its side and top walls spaced to accommodate the ferrules 14 on the cables 6, the slots in the top wall being L-shaped. When the one arms 42 of the L-shaped slots extending to the side of the bar 32 are aligned with the slots 10, and the slots 46 in the side wall of the bar 32 are aligned with the slots 12, the bar 8 may be withdrawn from the cables 6 and the ferrules 14. When the cables 6 are in the slots 10, and the bar 32 is moved lengthwise so that the ferrules enter the other arms 44 of the L-shaped slots extending parallel to the length of the bar, the cables are locked into the bar.

At the top of the panel, a spreader bar 48 is provided, with pairs of oppositely directed L-shaped slots 50 receiving the cables 6 formed by each individual length of cable, so as to sustain the lateral forces exerted on the cables by the connecting portion between them when it passes across a pulley 52. Referring again to FIG. 1, the pulleys 52 are suspended from further pulleys 54, which in turn are suspended upon loops in a cable 56 which extends between anchorages 58 at opposite ends of an upper support bar 60, by means of a sling 62 on which the panel may be lifted by a suitable crane of which only the hook 64 is shown. The loops in the cable 56 are formed by passing it over a series of pulleys 66 spaced along the underside of the bar 60.

In use of the invention, the cables 6 are inserted into the assembled panel through the apertures 4 in the blocks 2, and the bars 8 and 48 are slotted onto the cables at their top and bottom ends respectively, the ferrules 14 then being locked within the bar 8 by lengthwise movement of the bar 32. The pulleys 52 are then hooked onto the pulleys 54 suspended beneath the upper support bar 60, and the panel is lifted bodily from the support on which it was assembled or transported and laid into its final position as illustrated in FIG. 1, in which a panel 70 is shown being laid along side several previously laid similar panels 70. The panels should be oriented so that the slotted sidewall of the bar 8 is facing downwards. At this point the bar 32 may be moved lengthwise to release the ferrules 14 and enable the bar 8, together with the bar 32 to be lifted clear of the positioned panel. The cables 6 may then be pulled out of the panel. At some stage prior to this step, any permanent wires or cables 30 which are to be installed in the panel are attached by connectors 28 to the ferrules 24 so that they are drawn into the panels as the cables 6 are drawn out. The permanent cables may be attached at their lower ends to a substitute bottom support bar; typically this bar, if used, will be made of wood, which will eventually decay but will allow time for the panel to become firmly embedded on the surface to be protected. The attachment of the permament cables may be carried out immediately prior to the withdrawal of the cables 6 if the bottom end of the panel is accessible. If, for example, the bottom end of the panel is submerged, it will be more convenient to attach the permanent cables at an earlier stage prior to positioning of the panel. Since only lengthwise movement of the bar 32 is required in order to release the bar 8 from the cables 6, this may readily be achieved even when the bar is submerged by means of a cable attached to the end of the bar 32.

Although the cables 6 will need to be quite robust and expensive in order to sustain the weight of the panel and provide reasonable resistance to corrosion, these cables may of course be reused very many times. Since the permanent cables 30 do not have to bear the suspended weight of the complete panel, they need to be no stronger than is required for their function of holding the panel together once in position on the bank to be protected, and therefore a substantial economy is achieved. Moreover, the pulleys 54 and 66 act to equalize the load transmitted through each of the pulleys 54, and thus in conjunction with the pulleys 52, equalize the loadings on the cables 6. It would of course be possible for the cables 6 to be individually connected to pulleys 54 rather than pairs of cables 6 being formed by single cables passing across the pulleys 52. The arrangement described is however more economical. Other methods of equalizing the loading on the cables 6 could also be utilized, for example making use of springs and/or equalizing beams.

What I claim is:

1. Apparatus for laying preassembled panels of interlocking blocks comprising a bottom support bar for supporting the weight of the blocks when suspended in a vertical plane, a plurality of parallel suspension cables passing vertically through passages in said blocks and through said bottom support bar, and an upper support bar from which said cables are suspended at their top ends, the cables having coupling means at their bottom ends for releasably connecting thereto further wires or cables, the bottom support bar and the cables having mutually engageable abutment means whereby the weight of the panel may be transferred from the support bar to the cables, the bar being laterally moveable into and out of the plane of the panel between a position in which said abutment means are engaged and a position in which the bar is free of the cables.

2. Apparatus according to claim 1, wherein locking means are provided on said bottom support bar to lock said abutment means in engagement.

3. Apparatus according to claim 1, wherein the bottom support bar is of inverted channel section, and is slotted in its top and side to receive the cables and the abutment means on the cables, the edges of the slots in the top of the channel section forming the abutment on the bar.

4. Apparatus according to claim 3, wherein a second bar slides within the support bar, and is provided with L-shaped slots, the one arms of which extend to the edge of the bar, the bar being moveable between a position in which said one arms coincide with the slots in the support bar, permitting it to be engaged with or withdrawn from the cables, and a position in which the slots do not so coincide, thus locking the cables within the other arms of the L-shaped slots when the abutments are in mutual engagement.

5. Apparatus according to claim 1, wherein the suspension cables are connected to the upper support bar by means to equalize the loadings on the cables.

6. Apparatus according to claim 5, wherein a cable is connected between ends of the upper support bar, and pulleys are secured to the support bar at intermediate points and are in engagement with the cable so that the latter forms a series of depending loops, a second series of pulleys is suspended from these loops, and the suspension cables are connected to the pulleys of these further series.

7. Apparatus according to claim 6, wherein each adjacent pair of suspension cables is formed by a single length of cable, a further pulley is suspended from each pulley of said second series of pulleys, and each length of cable forming a pair of suspension cables is looped over one of said further pulleys.

8. Apparatus according to claim 7, further including a spreader bar, slotted to receive the cables, placed on top of the preassembled panel to sustain lateral forces which would otherwise be transmitted to the blocks by the suspension cables.

* * * * *